US010065229B2

(12) United States Patent
Flehmig et al.

(10) Patent No.: US 10,065,229 B2
(45) Date of Patent: Sep. 4, 2018

(54) METHOD FOR PRODUCING HIGHLY DIMENSIONALLY ACCURATE HALF-SHELLS AND APPARATUS FOR PRODUCING A HALF-SHELL

(71) Applicant: THYSSENKRUPP STEEL EUROPE AG, Duisburg (DE)

(72) Inventors: Thomas Flehmig, Ratingen (DE); Konstantinos Savvas, Düsseldorf (DE); Michael Brüggenbrock, Rosendahl (DE); Jörg Gorschlüter, Hamm (DE)

(73) Assignee: THYSSENKRUPP STEEL EUROPE AG, Duisburg (DE)

( * ) Notice: Subject to any disclaimer, the term of this patent is extended or adjusted under 35 U.S.C. 154(b) by 287 days.

(21) Appl. No.: 14/784,950

(22) PCT Filed: Apr. 8, 2014

(86) PCT No.: PCT/EP2014/057058

§ 371 (c)(1),
(2) Date: Oct. 15, 2015

(87) PCT Pub. No.: WO2014/170173

PCT Pub. Date: Oct. 23, 2014

(65) Prior Publication Data

US 2016/0052037 A1 Feb. 25, 2016

(30) Foreign Application Priority Data

Apr. 15, 2013 (DE) ..... 10 2013 103 751

(51) Int. Cl.
*B21D 22/20* (2006.01)
*B21D 22/30* (2006.01)

(52) U.S. Cl.
CPC ..... *B21D 22/20* (2013.01); *B21D 22/201* (2013.01); *B21D 22/30* (2013.01)

(58) Field of Classification Search
CPC ..... B21D 22/20; B21D 22/22; B21D 22/26; B21D 22/30; B21D 24/04; B21D 24/10; B21D 22/201
See application file for complete search history.

(56) References Cited

U.S. PATENT DOCUMENTS 909,342 A * 1/1909 Smith ..... B21D 22/22 72/350
2,681,630 A * 6/1954 Hempel ..... B21D 22/22 72/350

(Continued)

FOREIGN PATENT DOCUMENTS

CN 2520962 Y 11/2002
DE 102007052584 A1 5/2009

(Continued)

OTHER PUBLICATIONS

English language Abstract for JP 2005103579 A.

(Continued)

*Primary Examiner* — Edward Tolan
(74) *Attorney, Agent, or Firm* — thyssenkrupp North America, Inc.

(57) ABSTRACT

The invention relates to a method for producing highly dimensionally accurate half-shells from a tailored blank, wherein, in a first die, with optional use of at least one hold-down means, the half-shell is subjected to pre-shaping by deep drawing, wherein the first die has at least one punch, a die base, a die rest surface and a jacket region, and wherein the pre-shaped half-shell is subsequently subjected to final shaping in a second die, in particular in a calibration tool. The object of specifying a method which simplifies the production of highly dimensionally accurate half-shells is achieved in that, before the deep drawing, the blank is tailored by cutting, taking into consideration the desired final shape of the pre-shaped and/or finally shaped half- (Continued)

shell, with a positive dimensional deviation in the predefined tolerance range, the die base of the first die is moved relative to the die rest surface, the blank is clamped between the die base and the punch of the first die, and the blank is deep-drawn in a guided manner.

11 Claims, 5 Drawing Sheets

(56) References Cited

U.S. PATENT DOCUMENTS

| | | | | |
|---|---|---|---|---|
| 3,263,637 | A * | 8/1966 | Cox | B21D 22/26 72/343 |
| 3,483,723 | A * | 12/1969 | Verkaik | B21D 22/22 72/350 |
| 3,789,649 | A * | 2/1974 | Clowes | B21D 22/22 413/69 |
| 5,604,044 | A * | 2/1997 | McCabe | B21D 22/22 220/62 |
| 2010/0133724 | A1 | 6/2010 | Flehmig et al. | |
| 2010/0187291 | A1 | 7/2010 | Kriegner et al. | |
| 2011/0016945 | A1 * | 1/2011 | Nakao | B21D 22/06 72/358 |
| 2011/0165431 | A1 | 7/2011 | Inoue et al. | |
| 2012/0282482 | A1 | 11/2012 | Flehmig et al. | |
| 2014/0047891 | A1 | 2/2014 | Flehmig et al. | |
| 2014/0182349 | A1 * | 7/2014 | Yonemura | B21D 22/26 72/349 |
| 2017/0225216 | A1 | 8/2017 | Flehmig et al. | |

FOREIGN PATENT DOCUMENTS

| | | | |
|---|---|---|---|
| DE | 102007059251 | A | 6/2009 |
| DE | 102007059251 | A1 | 6/2009 |
| DE | 102008037612 | A1 | 6/2010 |
| DE | 102009059197 | A1 | 6/2011 |
| DE | 102011050001 | A1 | 10/2012 |
| EP | 1422385 | A1 | 5/2004 |
| EP | 2125263 | B1 | 6/2010 |
| JP | 2000288641 | A | 10/2000 |
| JP | 2005103579 | A | 4/2005 |
| WO | 2005105336 | A1 | 11/2005 |
| WO | 2009071437 | A1 | 6/2009 |

OTHER PUBLICATIONS

English language Abstract for DE 102007059251 A1.
German Language International Search Report for International patent application No. PCT/EP2014/057058; dated May 20, 2014.
English translation of International Search Report for International patent application No. PCT/EP2014/057058; dated May 20, 2014.
German language Written Opinion of the International Search Authority (the EPO) for International patent application No. PCT/EP2014/057058.
German language International Preliminary Report on Patentability (Chapter II of the PCT) for International patent application No. PCT/EP2014/057058.
English translation of the International Preliminary Report on Patentability (Chapter II of the PCT) for International patent application No. PCT/EP2014/057058.
English translation of abstract of JP 2000288641 A1.
English translation of abstract of DE 102007052584 A1.

* cited by examiner

State of the Art

METHOD FOR PRODUCING HIGHLY DIMENSIONALLY ACCURATE HALF-SHELLS AND APPARATUS FOR PRODUCING A HALF-SHELL

CROSS REFERENCE TO RELATED APPLICATIONS

This application is a U.S. National Stage Entry of International Patent Application Serial Number PCT/EP2014/057058, filed Apr. 8, 2014, which claims priority to German patent application no. DE 102013103751.8 filed Apr. 15, 2013, the entire contents of both of which are incorporated herein by reference.

FIELD

The present disclosure relates to a method for producing a highly dimensionally accurate half-shell from a tailored blank and an apparatus for producing a half-shell.

BACKGROUND

It is known from the prior art for highly dimensionally accurate half-shells to be produced by deep-drawing a blank.

For example, from DE 10 2007 059 251 A, it is known for highly dimensionally accurate half-shells to be produced in a two-stage process. For this purpose, pre-shaped half-shells are firstly produced, which pre-shaped half-shells have excess material over the entire cross section owing to their geometrical shape. Subsequently, the pre-shaped half-shells are upset into their final shape by way of a further pressing process. A half-shell produced in this way exhibits particularly high dimensional accuracy, as the springback of the half-shell has the introduced upset superposed thereon.

A disadvantage of said production method is however that the pre-shaped half-shells must generally undergo further trimming in order that they exhibit the desired dimensions, in particular with regard to the jacket height. To optimize the process chain, it is known, for example from DE 10 2011 050 001 A1, for the final trimming to be integrated into the deep-drawing process. To produce flangeless drawn parts, it is provided in said document that the flange region of the half-shell is trimmed in the region of the die rest surface. Subsequently, the pre-shaped half-shell produced in this way is calibrated in the same tool by way of a upset shoulder arranged on the drawing punch. Said method however furthermore has the disadvantage that excess blank material becomes trimmed waste, and the integration of the cutting edge into the deep-drawing die is subject to a high level of tool wear. Furthermore, it cannot be adequately ensured that the blank does not change its position during the deep-drawing process, resulting in dimensional inaccuracies of the pre-shaped half-shell being generated, which in turn necessitate trimming in the flange or jacket region.

EP 2 125 263 B1 proposes that, to optimize the efficiency of the temperature-controlled deformation of hot-rolled steel by deep drawing, both the deformation and the calibration of the component be performed in one drawing die. To fix the blank during the deformation process, said blank is clamped between the punch and the die base, which is displaceable parallel to the direction of movement of the punch, and said blank is deep-drawn in guided fashion in the clamped state. Subsequently, the component is stamped by virtue of a further upset shoulder being moved against it. Said method, too, has the disadvantage that the tools for the production of a deep-drawn part are complex.

SUMMARY

One object of the present disclosure is to provide a method and an apparatus which respectively simplifies the production of highly dimensionally accurate half-shells. In one aspect of a method of the present disclosure, in a first die, with optional use of at least one hold-down means, a half-shell is subjected to pre-shaping by deep drawing, wherein the first die has at least one punch, a die base, a die rest surface and a wall region. In a next step, the pre-shaped half-shell is subsequently subjected to final shaping in a second die, in particular in a calibration tool.

BRIEF DESCRIPTION OF THE DRAWINGS

The present disclosure is described in detail below with reference to the attached drawing figures, wherein.

DETAILED DESCRIPTION

Figure 1:
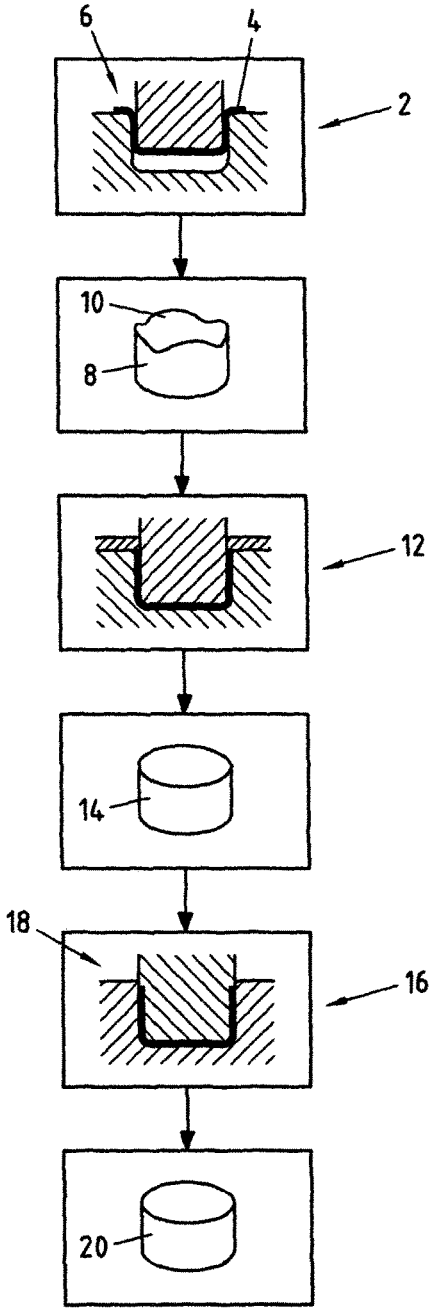
FIG. 1 is schematic flow chart depicting a prior art embodiment of a method for producing a highly dimensionally accurate flangeless half-shell.

According to a first teaching of the present invention, said object is achieved by way of the method mentioned in the introduction in that, before the deep drawing, the blank is tailored by cutting, taking into consideration the desired final shape of the pre-shaped and/or finally shaped half-shell, with a positive dimensional deviation in the predefined tolerance range, the die base of the first die is moved relative to the die rest surface, the blank is clamped between the die base and the punch of the first die, and the blank is deep-drawn in a guided manner. It may for example be provided that the die base, before the deep drawing, is moved into a plane with the die rest surface, such that the blank lying on the die rest surface is clamped between the die base and the punch by virtue of the die base being moved further against said blank or by virtue of the punch being moved against said blank. The blank may optionally also be clamped beforehand between the at least one hold-down means and the die rest surface, such that the blank can be fixed in slip-resistant fashion at least until the time at which the blank is clamped by the punch and the die base. It is furthermore optionally possible for the blank to be positioned in the intended position in the tool by way of suitable fixing and/or centering means until the clamping by way of the punch and the die base has been realized. For optional clamping between the hold-down means and die rest surface, it is for example possible for the die rest surface to be moved in the direction of the hold-down means, though it is also conceivable for the at least one hold-down means to be moved in the direction of the die rest surface and to thus exert pressure on the blank. In the subsequent deep-drawing process, the blank is, according to the invention, deep-drawn in guided fashion. Within the meaning of the present invention, a guided deep-drawing process is to be understood to mean a deep-drawing process of a blank, wherein the blank is clamped between the punch and the die base during the deep-drawing process. In other words, during the deep-drawing process, the die base subjects the blank to an opposing pressure in relation to the exertion of force by the punch. The die base can consequently be acted on with a regulable force before and/or during the deep drawing. This has the advantage that, during the deep drawing, the blank cannot slip in uncontrolled fashion, and is instead connected in positively locking and non-positively locking fashion to the die base and to the blank as a result of the clamping. Before the deep drawing, the blank is tailored by cutting, taking into consideration the desired final shape of the pre-shaped and/or finally shaped half-shell, with a positive dimensional deviation in the predefined tolerance range. Through the combination of the use of a blank tailored in this way and the guided deep-drawing process, it is possible to produce a pre-shaped half-shell which already exhibits dimensional accuracy in terms of edges and shape, and which in particular has a defined jacket height and/or flange width, which can eliminate the need for final edge trimming of the half-shell. Altogether, the process chain for producing a highly dimensionally accurate half-shell can be shortened, and use can be made of simple tools. As a result, by means of the method according to the invention, the process of producing a highly dimensionally accurate half-shell can be optimized and simplified. With the method according to the invention, it is possible to produce half-shells with a flange or flangeless half-shells.

In one advantageous refinement of the method according to the invention, the die base of the first die is, before the deep drawing, raised above the edge of the die rest surface. It is advantageously then possible for the blank to be clamped between the punch and the die base particularly easily. Furthermore, it is possible to prevent a situation in which, during the clamping between the die base and the punch, the blank slips, for example owing to the pressure of the punch, or is deformed outside the region of the die base.

The blank is preferably stamped as a result of the clamping in the region of the die base, such that the blank assumes the shape of the die base. If the die base has a structure, for example in the form of an undulation, such structure can be transferred to the blank by way of the stamping. The preshape has, owing to the shape of the base, excess material which can be utilized advantageously in the subsequent final shaping process. It is optionally the case that, before the deep drawing, the blank is also stamped as a result of clamping between the die rest surface and the at least one hold-down means. The wall region and optionally the flange region take on excess material, which results from the shape of the blank and/or from the preshape and the design of the tool.

In a further preferred embodiment of the method according to the invention, the blank is, before and/or during the deep drawing, positioned in slip-resistant and/or reproducible fashion using positive locking and non-positive locking means and/or using fixing and/or centering means. For example, it is conceivable for the blank to be fixed in its position before the deep drawing by way of delimiters, guides, pins, magnets or other positive locking and/or non-positive locking means. Said fixing is preferably realized at least up until the time at which the blank is clamped between the punch and the die base. By means of repeatably accurate positioning and/or fixing of the blank before the deep drawing, it can be ensured that the deep-drawn blank has the desired final dimensions, in particular with regard to the jacket height and/or the flange width. During the deep drawing, the blank is preferably fixed to the die base and to the punch by way of the positively locking and non-positively locking connection, such that uncontrolled slippage of the blank during the deep drawing process can be prevented.

It is furthermore advantageous if the optionally at least one hold-down means, through the setting of the spacing thereof to the die rest surface, which corresponds at least to the actual thickness of the blank, exerts no force, or only a small force, on the blank during the deep drawing, such that ironing of the blank is substantially prevented. Through the prevention of ironing of the blank in the jacket region, it can be ensured that only minor material fluctuations, for example with regard to the thickness of the jacket region, are introduced into the dimensions of the pre-shaped half-shell by the deep-drawing process.

It is particularly preferably provided that the vertical spacing between the at least one hold-down means and the die rest surface is set to the actual thickness of the blank, and, during the deep drawing, the hold-down means exerts no force, or only a small force, on the blank, such that ironing of the blank is substantially prevented. In this state, the at least one hold-down means limits the movement of the blank. In the context of the present invention, the actual thickness of the blank is to be understood to mean the true thickness of the blank. For example, the true blank thickness can be measured. Furthermore, it is also conceivable for the spacing between the at least one hold-down means and the die rest surface to be reduced to such an extent that the hold-down means is acted on by an opposing pressure exerted by the blank. In addition to the force exerted on the blank by the at least one hold-down means, it is advantageous if the friction of the blank on the die, in particular in the region of the die rest surface and in the jacket region, remains constant during the deep drawing. This may be achieved for example by virtue of the deep-drawing process being performed with a substantially constant speed. Furthermore, the method is preferably always implemented in the same orientation with respect to the rolling direction of the blank. As the behavior of the material during the deep drawing is dependent on the rolling direction of the blank, dimensional inaccuracies of the pre-shaped half-shell can be avoided by way of a consistent orientation of the rolling direction of the blank with respect to the direction of the deep drawing.

In a particularly preferred refinement of the method according to the invention, before the deep drawing, the blank is tailored by cutting, taking into consideration the material flow during the deformation, such that rim and/or edge trimming is not required after the deformation. The tailored outline of the blank is determined by virtue of in particular positive dimensional deviations of the pre-shaped or finally shaped half-shell being transferred reciprocally to the starting blank. Taking into consideration the flow laws of the material flow, it is thus possible to determine a blank contour which, after the deep drawing, yields a half-shell which is dimensionally accurate in terms of edges and shape and which does not require any final rim and/or edge trimming, or which can be adjusted to the required dimensions by compression. Through the additional consideration of the material flow, the tailored outline, thus determined, of the blank may deviate from the tailored outline defined in claim 1. Taking into consideration the material flow during the deep drawing, it is also possible for holes of the pre-shaped half-shell to be formed already into the starting blank. By virtue of the fact that, as a result, no rim and/or edge trimming of the half-shell is required, and accordingly no trimmed material waste is generated, the process of producing a highly dimensionally accurate half-shell can be simplified, and efficiency can be increased.

Furthermore, on the optionally at least one hold-down means and/or on the first die, there may be arranged a cutting edge by way of which the final trimming of the pre-shaped half-shell is performed. Alternatively, it is also possible for the cutting edge to be provided in the region of the punch. The half-shell is preferably trimmed in the wall region and/or flange region after the deep drawing.

The pre-shaped half-shell produced in accordance with one of the above-described embodiments of the method according to the invention has a fully formed contour of the half-shell. If a flange region is provided, this has the intended width.

If no flange is provided, the flange material at the end of the deep-drawing process flows into the jacket region and becomes a constituent part thereof, such that as a result, a half-shell with a defined jacket height and without a flange is provided.

According to the invention, the pre-shaped half-shell produced in accordance with one of the above-described deep-drawing processes is subjected to final shaping in a second die. Within the meaning of the present invention, the final shaping of the half-shell is to be understood to mean a calibration of the half-shell for the purposes of producing the particularly high dimensional accuracy. The final shaping process preferably accounts for between 10 and 20% of the entire process chain. It is particularly advantageous if the half-shell is transferred from the first die to the second die by means provided for the purpose. Any dimensional inaccuracies still present can be eliminated through the calibration of the half-shell.

The pre-shaped half-shell preferably has excess material which, during the final shaping in the second die, is impacted by way of a calibrating punch. It is conceivable for the excess material to be provided through the formation of a structure, for example an undulation, into the base region of the half-shell or, in the case of flanged parts, also in the flange region, preferably in all horizontal regions. The formation of some other structure which results in the provision of excess material in the deep-drawn part is likewise suitable for the present method. Alternatively or in addition, it is conceivable for the excess material to be provided through the formation of a corresponding structure into the jacket region. What is likewise suitable is the provision of excess material by way of an elongated jacket and/or flange region of the pre-shaped half-shell. Said excessive material is preferably upset during the calibration. The upset that is introduced compensates the springback of the half-shell, such that, after the removal of the half-shell from the second die, springback of the material can be successfully prevented. Particularly high dimensional accuracy of the half-shell that is produced can be ensured as a result.

It is conceivable for the method according to the invention to be carried out at room temperature as part of a cold forming process. Furthermore, it is however also possible for the method according to the invention to be performed as part of a hot forming or warm forming process. For this purpose, the blank is heated to forming temperature.

The method according to the invention is particularly suitable for the production of half-shells from steel or a steel alloy. Therefore, in a preferred embodiment, the blank for producing the pre-shaped half-shell is composed of steel or a steel alloy.

According to a second teaching of the present invention, the object mentioned in the introduction is achieved by way of an apparatus having at least one first die for producing a pre-shaped half-shell, wherein the first die has at least one punch, a die base, a die rest surface and a jacket region, and at least one hold-down means is optionally provided, in that the die base is displaceable relative to the die rest surface such that the blank can be clamped between punch and die base. It is advantageously possible for the die base to be raised above the plane of the die rest surface, such that the blank can be clamped between the die base and the punch particularly easily. It is furthermore advantageous if the blank can be clamped between the punch and the die base such that said blank is simultaneously stamped, and thus assumes the shape of the die base. In this way, a structure can be formed in, for example for the purposes of providing a material reserve in the base region of the half-shell. Furthermore, the blank can be deep-drawn in guided fashion in the clamped state. For this purpose, the apparatus is preferably arranged in a press.

In a preferred embodiment of the die according to the invention, the die rest surface and the optionally at least one hold-down means are arranged so as to be displaceable relative to one another. A blank situated on the die rest surface can, by virtue of the at least one hold-down means and/or the die rest surface being moved against it, be clamped in the region of the die rest surface, for example in order to be fixed in position, before the deep drawing. The blank may preferably be clamped such that it is simultaneously stamped and assumes the shape of the die rest surface.

It is furthermore preferable if positive-locking and/or non-positive locking means and/or fixing and/or centering means are provided, by way of which a blank can be positioned in slip-resistant and/or reproducible fashion before and/or during the deep drawing. For example, delimiters, guides, pins, magnets or other positive locking and/or non-positive locking means may be provided. The blank is preferably held in its position in slip-resistant fashion during the deep drawing as a result of the clamping between the punch and the die base. Owing to the precise and reproducible fixing of the blank in position, the dimensional accuracy of the pre-shaped half-shells can be ensured.

In a further embodiment of the apparatus according to the invention, a cutting edge may be arranged on the optionally at least one hold-down means and/or on the first die or alternatively in the region of the punch, by means of which cutting edge final trimming of the pre-shaped half-shell can be performed. It is thus advantageously possible for the jacket height and/or the flange width of the pre-shaped half-shell to be influenced even after the deep-drawing process.

It is furthermore advantageous if the die base and/or flange region, or the horizontal regions, in the deep-drawing tool have a shape which is suitable for providing excess material of the pre-shaped half-shell. If the blank is clamped between the punch and the die base in such a way that it is simultaneously stamped and thus assumes the shape of the die base, it is thus possible for the structure for providing excess material to be formed into the base of the half-shell particularly easily. An undulating form is suitable, for example. Other structures are however also conceivable.

In a further preferred embodiment of the apparatus according to the invention, at least one second die is provided for the final shaping and/or calibration of the pre-shaped half-shell, which at least one second die optionally has means for transferring the half-shell from the first die to the second die.

The invention will be discussed in further detail below with reference to the attached drawing figures.

FIG. 1 shows a method for producing a highly dimensionally accurate half-shell as per the prior art. In a first step 2, a blank 4 is deep-drawn in a first die 6. After the deep-drawing process 2, the half-shell 8 thus produced has ears 10 which reduce the dimensional accuracy of the pre-shaped half-shell 8. In a subsequent step 12, said ears 10 are removed by trimming the half-shell 8. This may be performed either in a further die or else may be integrated into the first deep-drawing process 2. After the final trimming 12, the wall region of the flangeless half-shell 14 has the desired target height. Owing to the deep-drawing process 2, the half-shell 14 exhibits dimensional inaccuracy which can be eliminated in a subsequent final shaping step 16 by way of a calibration tool. As a result, a highly dimensionally accurate half-shell 20 can be produced in this way. Said method however has the disadvantage that, owing to the trimming 12, the process chain for producing a highly dimensionally accurate half-shell 20 is lengthened, and if the trimming is integrated into the deep-drawing process, complex tools are required for the production process. Furthermore, trimmed material waste is generated, whereby the efficiency of the production method is reduced.

Figure 2:
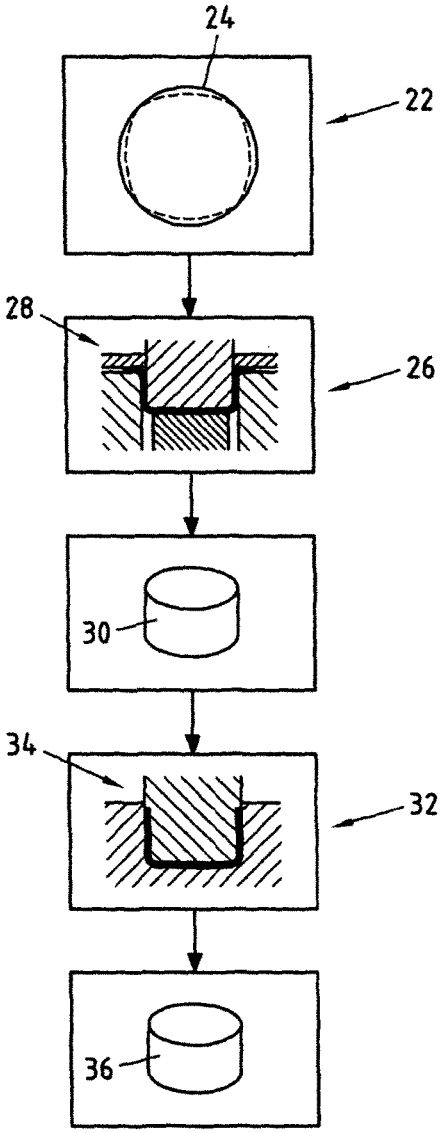
FIG. 2 is a schematic flow chart depicting an embodiment of a method of the present disclosure for producing a flangeless half-shell.

FIG. 2 now shows a first exemplary embodiment of the method according to the invention for producing a flangeless half-shell. In a first step, before the deep drawing, the blank 24 in the present exemplary embodiment is tailored by cutting, taking into consideration the desired final shape of the pre-shaped and/or finally shaped half-shell, with a positive dimensional deviation in the predefined tolerance range, such that rim and/or edge trimming is no longer required as part of the production method. Said trimming is however optional. In a second step 26, the tailored blank is deep-drawn in guided fashion by means of a first die 28. For an explanation of the guided deep-drawing process, reference is made to the description of FIG. 4*b*. After the deep-drawing process 26, the pre-shaped half-shell 30 has defined dimensions, in particular with regard to the wall height. In the following final shaping step 32, the pre-shaped half-shell 30 is calibrated in a second die 34. It is particularly advantageous if the pre-shaped half-shell 30 is transferred into the second die 34 by transfer means. With the method according to the invention, a highly dimensionally accurate half-shell 36 can be produced in a particularly simple and efficient manner.

Figure 3A:
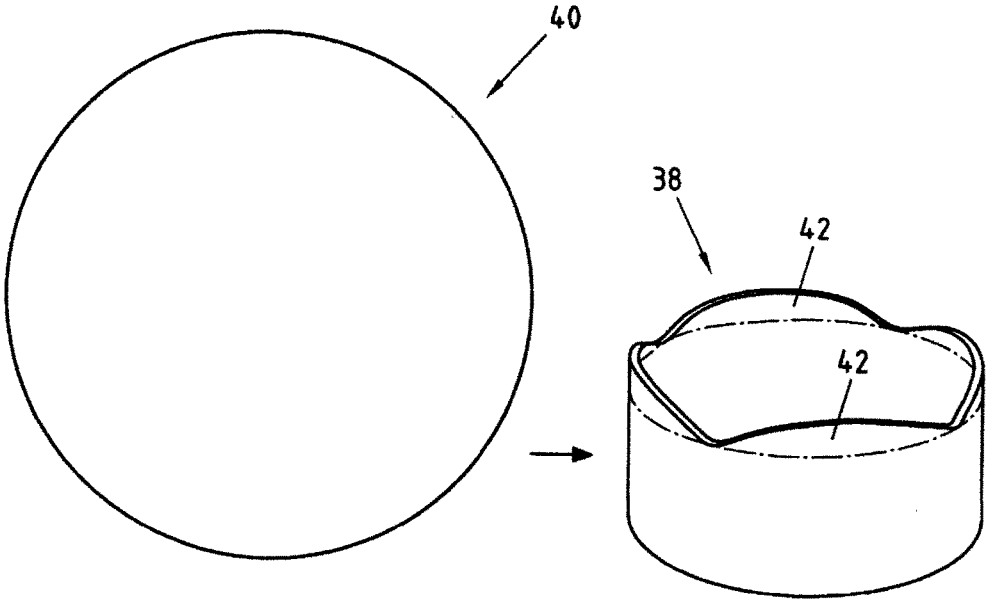
FIGS. 3*a-d* depict an embodiment of a method of the present disclosure for determining a tailored blank outline.
Figure 3B:
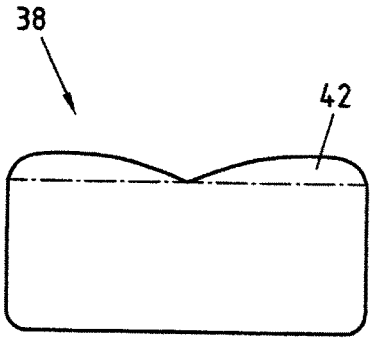
Figure 3C:
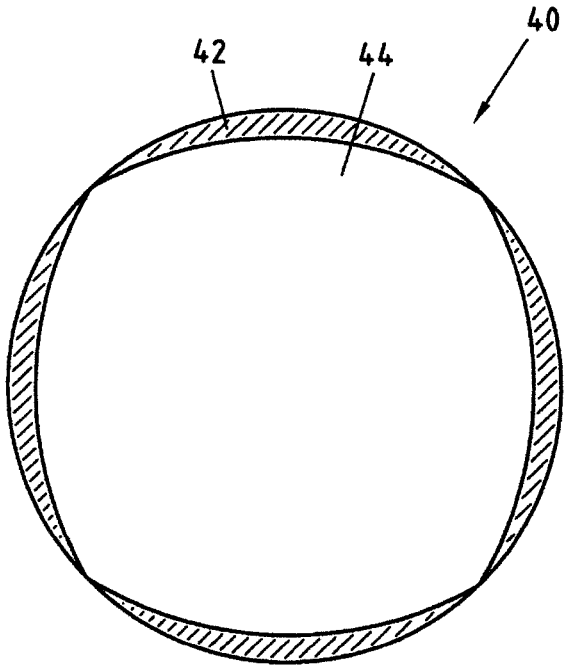
Figure 3D:
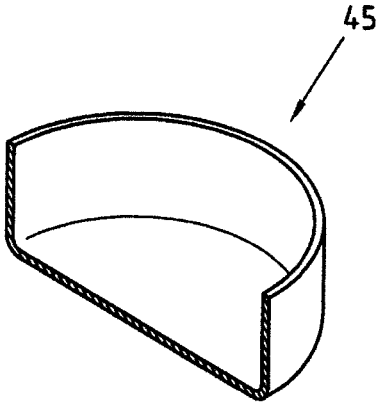

FIG. 3*a* to *d* show a first exemplary embodiment of the approach for determining the tailored blank outline before the deep drawing. In a first step, illustrated in FIG. 3*a*, taking into consideration the material flow, a deep-drawn half-shell 38 is simulated from a circular blank 40. The simulation shows that the deep-drawn half-shell 38 has undesired ears 42. Proceeding from the simulated deep-drawn half-shell 38, the areas of the undesired regions 42 are determined, as shown in FIG. 3*b*. In a subsequent step, the areas of the undesired regions 42 are transferred, by back-calculation, to the starting blank 40, whereby as a result, the area of the regions 42 to be removed is determined. FIG. 3*c* shows the starting blank 40 and the region 42 to be removed. A blank 44 corrected in this way can be deep-drawn to form a flangeless half-shell 45 which has defined dimensions, in particular with regard to the jacket height. FIG. 3*d* shows a simulation of a half-shell 45 deep-drawn from the tailored blank 44.

Figure 4A:
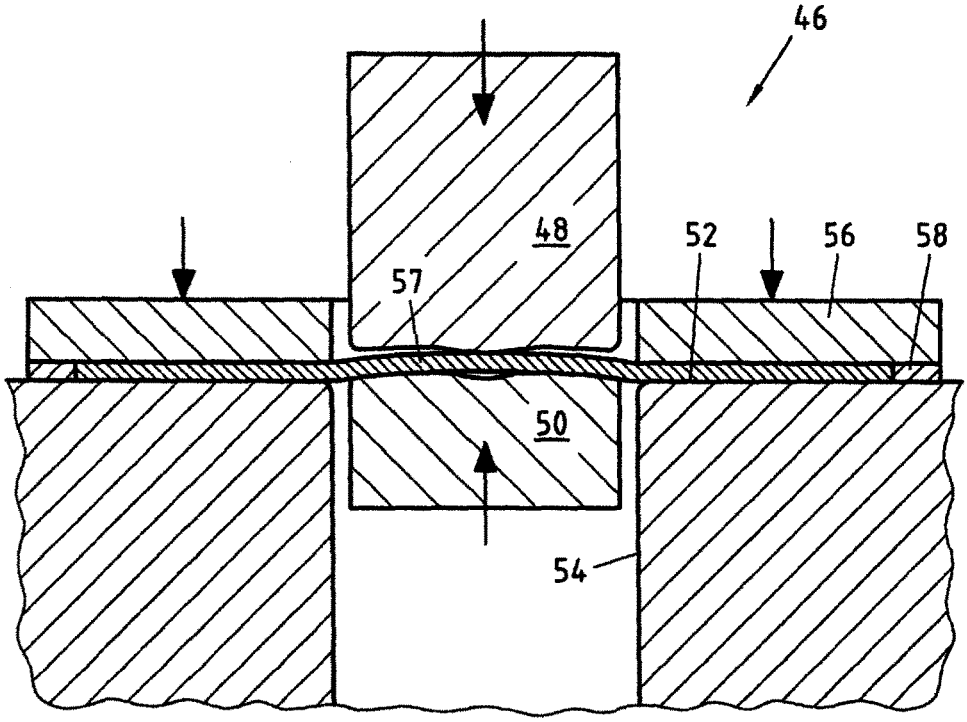
FIGS. 4*a-c* depict an embodiment of a deep-drawing process of the present disclosure for producing a pre-shaped half-shell, and an embodiment of a first die of an apparatus of the present disclosure.
Figure 4B:
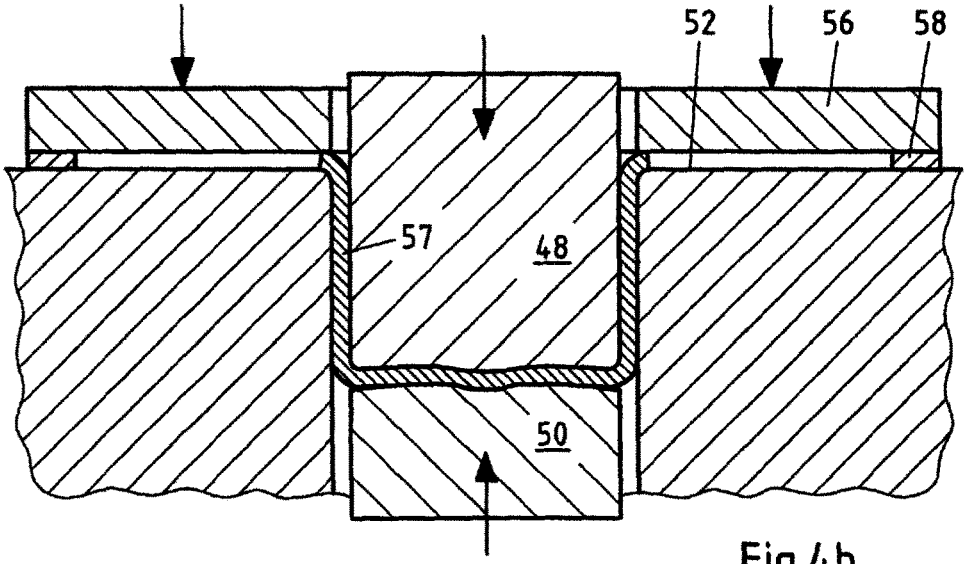
Figure 4C:
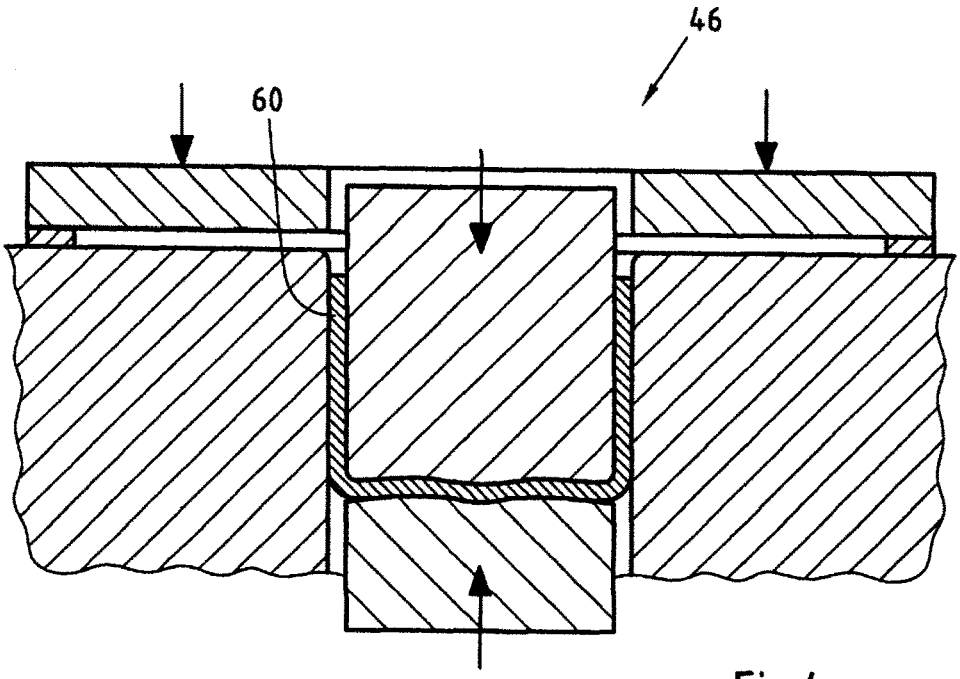

FIG. 4*a* to *c* show a first exemplary embodiment of the deep-drawing process according to the invention for producing a pre-shaped half-shell, and a first exemplary embodiment of a first die of the apparatus according to the invention. FIG. 4*a* shows a first die 46 with a punch 48, with a die base 50, with a die rest surface 52 and with a jacket region 54, a hold-down means 56, and a tailored blank 57. Furthermore, the die 46 has guides 58 which firstly hold the hold-down means 56 with a spacing to the die rest surface 52, said spacing corresponding at least to the blank thickness, and which secondly prevent slippage of the blank 57 on the die rest surface 52. By means of the guides 58, the blank 57 can be positioned in the die 46 in slip-resistant and reproducible fashion.

The die base 50 is displaceable relative to the die support surface 52. In the position shown in FIG. 4*a*, the die base 50 has been raised above the edge of the die rest surface 52. Furthermore, the punch 48 has been lowered to such an extent that the blank 57 is clamped between the punch 48 and the die base 50. The die base 50 has a shape which is suitable for providing excess material of the pre-shaped half-shell. For this purpose, the die base 50 has an undulating shape. In the exemplary embodiment shown, the blank 57 is clamped between the punch 48 and the die base 50 in such a way that said blank is simultaneously stamped and thus assumes the shape of the die base 50. The structure of the die base can thus be transferred into the base region of the pre-shaped half-shell, such that the half-shell has excess material in the base region, which excess material can be utilized advantageously during the final shaping process.

FIG. 4*b* shows the guided deep-drawing process of the blank 57. The illustration shows that the blank 57 is deep-drawn in the clamped state. Consequently, during the deep drawing, the blank 57 is subjected not only to the pressure exerted by the punch 48 but also to an opposing pressure exerted by the die base 50. During the deep drawing, the spacing of the hold-down means 56 is advantageously set to the blank thickness. Altogether, ironing of the blank 57 during the deep drawing is substantially prevented in this way. During the deep drawing process for producing a flangeless half-shell, the flange region of the blank 57 also flows into the jacket.

FIG. 4*c* now shows the deep-drawing process at a bottom dead center. The blank 57 has been shaped in its entirety to form a half-shell 60. The half-shell 60 shown in FIG. 4*c* has excess material both in its structured base region and also by way of an elongated jacket region. Owing to the absence of ironing during the deep drawing, the half-shell 60 thus produced springs back when removed from the die 46.

Figure 5:
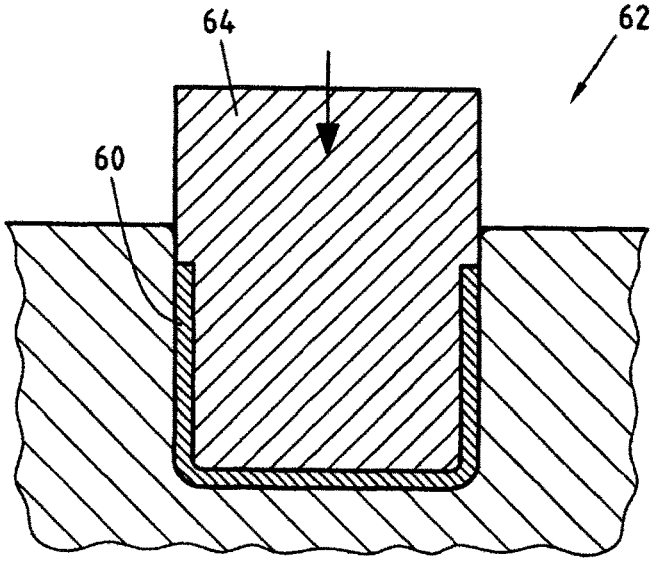
FIG. 5 depicts an embodiment of a final shaping step in a method of the present disclosure, and an embodiment of a second die of an apparatus of the present disclosure.

Therefore, the pre-shaped half-shell 60 shown in FIG. 5 is calibrated in a second die 62, preferably using a calibrating punch 64. In the exemplary embodiment illustrated, the excess material of the pre-shaped half-shell 60 is impacted, whereby, as a result, a highly dimensionally accurate half-shell can be produced which exhibits no springback effects when removed from the calibrating die 62.

The invention claimed is:

1. A method for producing a highly dimensionally accurate half-shell from a tailored blank, comprising:

cutting a blank to a predefined tailored shape having a positive dimensional deviation in a predefined tolerance range;

positioning the tailored blank on a die rest surface of a first die, by positive locking means, such that said blank positioning is reproducible, the first die further including at least one punch, a die base cooperatively operable with the at least one punch, and a jacket region defined adjacent to the die base;

moving the die base of the first die towards the die rest surface on which the tailored blank is positioned;

clamping the tailored blank between the die base and the punch of the first die;

deep-drawing the tailored blank in a guided manner in the first die to form a pre-shaped half-shell; and final shaping the pre-shaped half-shell in a second die that is a calibration tool.

2. The method of claim 1, further comprising, after said positioning step, applying at least one hold-down means of the first die to at least a portion of the tailored blank positioned therein, so as to maintain a position tailored blank in the first die.

3. The method of claim 1, further comprising, before the deep-drawing step, raising the die base of the first die above an edge of the die rest surface.

4. The method of claim 1, wherein said clamping step is also a stamping step that results in the blank being stamped in a region of the die base clamped adjacent the blank.

5. The method of claim 3, wherein a vertical spacing defined between the at least one hold-down means and the die rest surface is set to the actual thickness of the tailored blank, and wherein during the deep drawing step, any force exerted on the blank by the at least one hold-down means is sufficiently small so as to substantially prevent ironing of the blank.

6. The method of claim 1, wherein the predefined tailored shape of the cut blank is configured such that, after said deep-drawing step, the dimensions of the deep-drawn pre-shaped half-shell are within a predefined range that eliminates a need for at least one of a rim or edge trimming operation after said deep-drawing step.

7. The method of claim 1, wherein the pre-shaped half-shell resulting from said deep-drawing step has excess material, and wherein, during said final shaping step in the second die, impacting the excess material with a calibrating punch.

8. An apparatus for producing a half-shell, comprising:

at least one first die configured to produce a pre-shaped half-shell from a tailored blank, said at least one die having, a die cavity defined in said first die, at least one punch configured to force the tailored blank into the die cavity so as to form the tailored blank into a pre-shaped half-shell, a die rest surface configured to support the tailored blank prior to and during a deep-drawing process of the tailored blank to form the pre-shaped half-shell, positive-locking means in communication with said die rest surface and configured to permit reproducible positioning of the tailored blank in said first die prior to and during the deep-drawing process, a die base disposed within said die cavity and displaceable relative to said die rest surface, said die base being cooperatively operable with said at least one punch to clamp the tailored blank and guide the clamped blank into said die cavity during the deep-drawing process so as to help form the blank into the pre-shaped half-shell, a jacket region defined by a gap between sidewalls of said at least one punch and interior sidewalls of said die cavity, said jacket region configured to permit material from the tailored blank to form a jacket of the pre-shaped half-shell during the deep-drawing process.

9. The apparatus of claim 8, wherein said die rest surface and said at least one hold-down means are configured to be displaceable relative to one another.

10. The apparatus of claim 8, wherein said die base has a shape which is suitable for providing excess material of the pre-shaped half-shell.

11. The apparatus of claim 8, further comprising:

at least one second die configured to form to a final shape the pre-shaped half shells formed in the deep-drawing process by said at least one first die; and means for transferring the preformed half-shell from said first die to said second die.

* * * * *